US007544133B1

(12) United States Patent
Page et al.

(10) Patent No.: US 7,544,133 B1
(45) Date of Patent: Jun. 9, 2009

(54) CUE TIP CHALKING APPARATUS

(76) Inventors: Jeff G. Page, 8725 Via El Dorado, Alta Loma, CA (US) 91701; Victoria K. Page, 8725 Via El Dorado, Alta Loma, CA (US) 91701

( * ) Notice: Subject to any disclaimer, the term of this patent is extended or adjusted under 35 U.S.C. 154(b) by 40 days.

(21) Appl. No.: 11/669,046

(22) Filed: Jan. 30, 2007

(51) Int. Cl.
*A63D 15/16* (2006.01)

(52) U.S. Cl. ..... 473/35; 473/36; 473/38

(58) Field of Classification Search ..... 473/35–39
See application file for complete search history.

(56) References Cited

U.S. PATENT DOCUMENTS

| | | | | |
|---|---|---|---|---|
| 238,629 | A * | 3/1881 | Alexander | 473/38 |
| 337,311 | A * | 3/1886 | Davis | 473/38 |
| 468,278 | A * | 2/1892 | Shwerwood | 473/38 |
| 518,174 | A * | 4/1894 | Baldwin et al. | 473/38 |
| 1,273,219 | A | 7/1918 | Hall | |
| 1,332,431 | A * | 3/1920 | Darras | 473/38 |
| 3,781,008 | A | 12/1973 | Espinoza | |
| 3,894,735 | A | 7/1975 | Dickens | |
| 3,963,237 | A | 6/1976 | Bushberger | |
| D256,712 | S | 9/1980 | Bushberger | |
| 5,004,233 | A | 4/1991 | Phillips | |
| 5,129,187 | A * | 7/1992 | Cain | 451/28 |
| 5,865,682 | A | 2/1999 | Sutton | |
| 6,616,540 | B2 * | 9/2003 | Slacum | 473/36 |
| 6,755,750 | B1 * | 6/2004 | Schulte et al. | 473/37 |

FOREIGN PATENT DOCUMENTS

GB 2041767 A * 9/1980

* cited by examiner

*Primary Examiner*—Mitra Aryanpour

(57) ABSTRACT

A cue tip chalking apparatus includes a housing that has an outer peripheral wall. The peripheral wall has a well extending therein. The well has an outer peripheral edge defining an orifice of the well. A motor is mounted within an interior of the housing. A drive shaft is attached to the motor and extends toward the orifice. A saddle is attached to the drive shaft and is positioned in the well. The saddle releasably holds a cue chalk. A power source is electrically coupled to the motor. An actuator is electrically coupled to the motor and to the power source. The motor rotates the drive shaft when the actuator is placed in an on position. The cue tip is abutted against the cue chalk and the cue chalk rotated by the motor to place chalk on the cue tip.

7 Claims, 5 Drawing Sheets

CUE TIP CHALKING APPARATUS

BACKGROUND OF THE INVENTION

1. Field of the Invention

The present invention relates to cue chalking devices and more particularly pertains to a new cue chalking device for automatically chalking the cue tip of a cue.

2. Description of the Prior Art

The use of cue chalking devices is known in the prior art. While these devices fulfill their respective, particular objectives and requirements, the need remains for a device that is automatically turned on when the cue tip of a cue is extended into the device and abutted against a cue chalk. Further, the device should be mountable to a wall surface so that the device is in an easily accessible area and need not be held while the device is being used.

SUMMARY OF THE INVENTION

The present invention meets the needs presented above by generally comprising a housing that has an outer peripheral wall. An interior of the housing is defined as being bounded by the peripheral wall. The peripheral wall has a well extending therein that has a size greater than a cue chalk. The well has an outer peripheral edge defining an orifice of the well. A motor is mounted within the interior of the housing. A drive shaft is attached to the motor. The motor is configured to rotate the drive shaft when the motor is turned on. The drive shaft extends into the well and toward the orifice. A saddle is attached to the drive shaft and is positioned in the well. The saddle releasably holds a cue chalk. A power source is electrically coupled to the motor. An actuator is electrically coupled to the motor and to the power source. The actuator is positioned in an on position to turn the motor on or in an off position to turn the motor off. The motor rotates the drive shaft when the actuator is placed in the on position. The cue tip is abutted against the cue chalk and the cue chalk rotated by the motor to place chalk on the cue tip.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
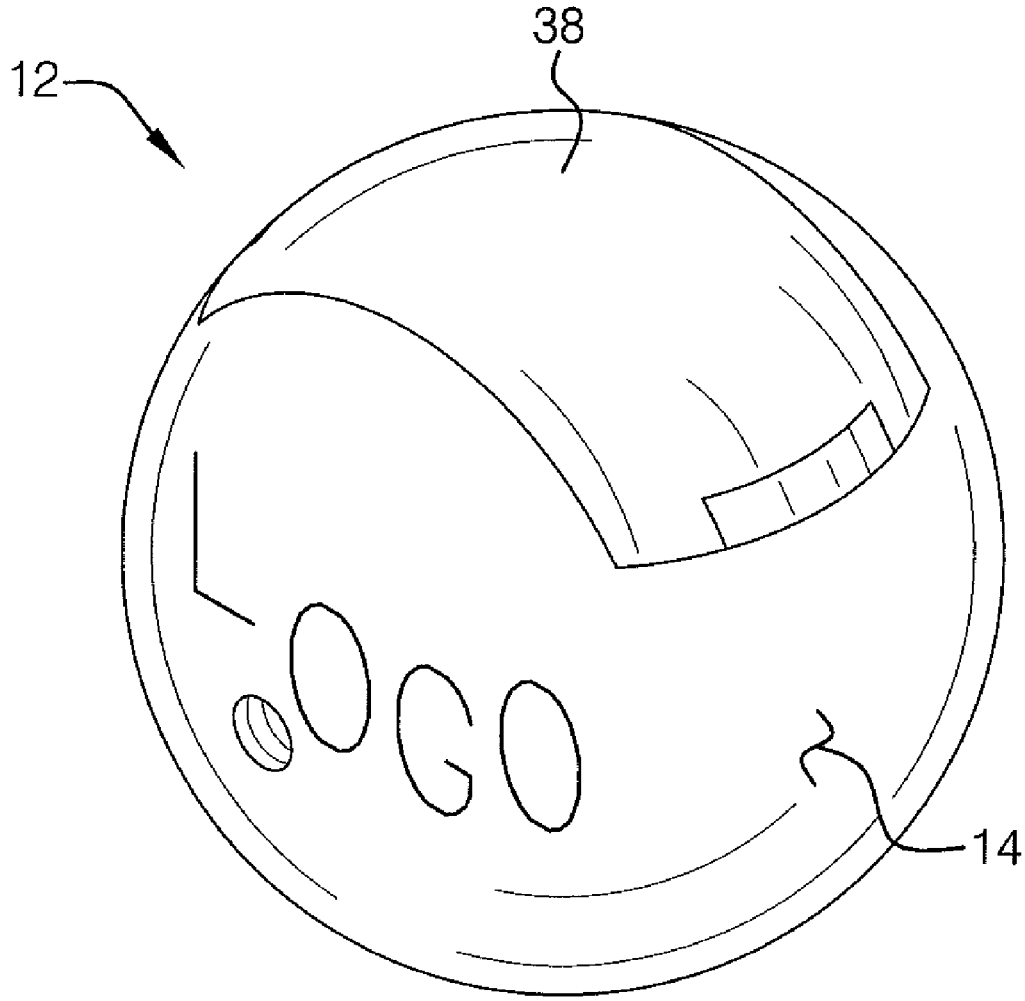
FIG. 1 is a perspective view of a housing of a cue tip chalking apparatus according to the present invention.
Figure 2:
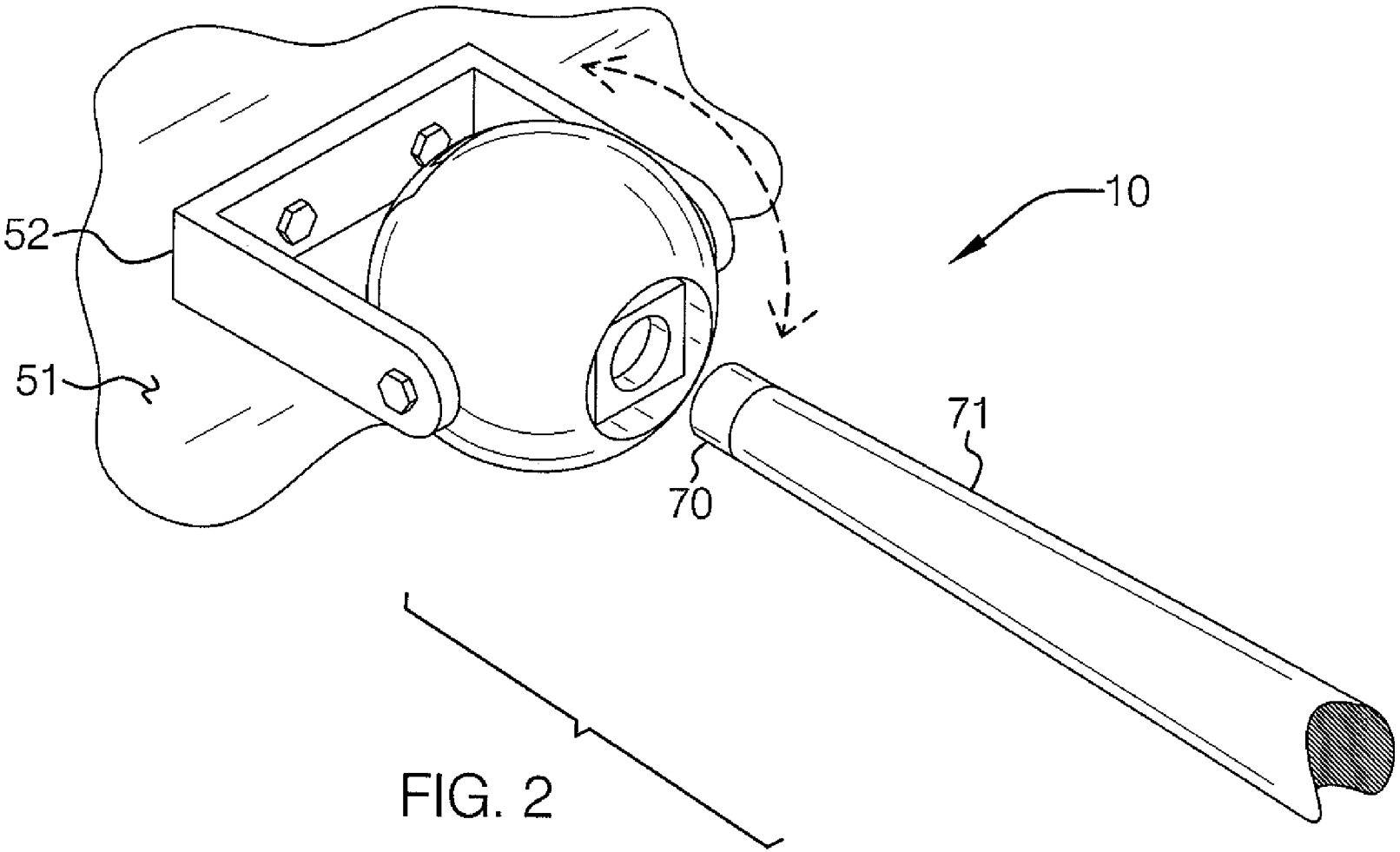
FIG. 2 is a perspective view of the present invention.
Figure 3:
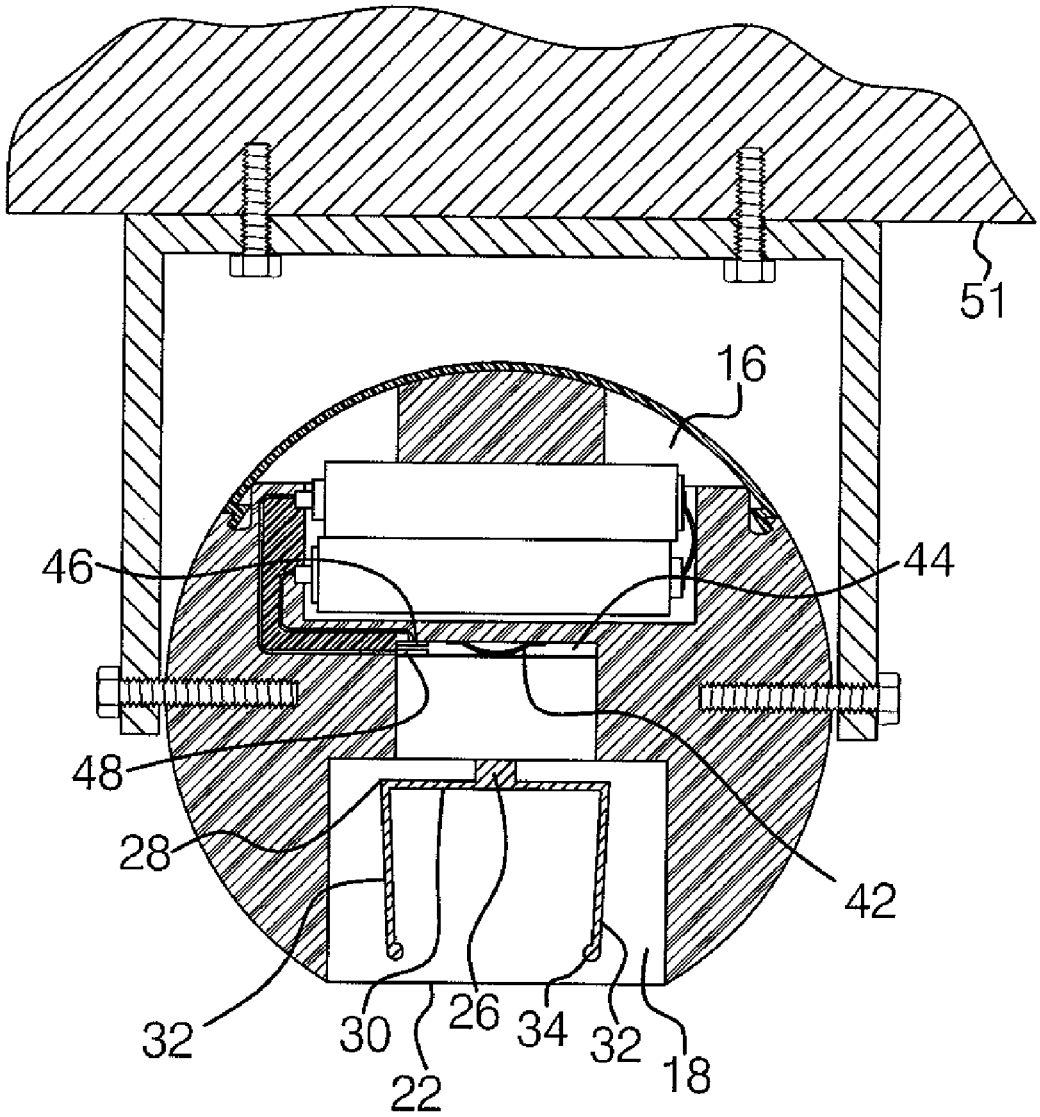
FIG. 3 is a cross-sectional view of the present invention.
Figure 4:
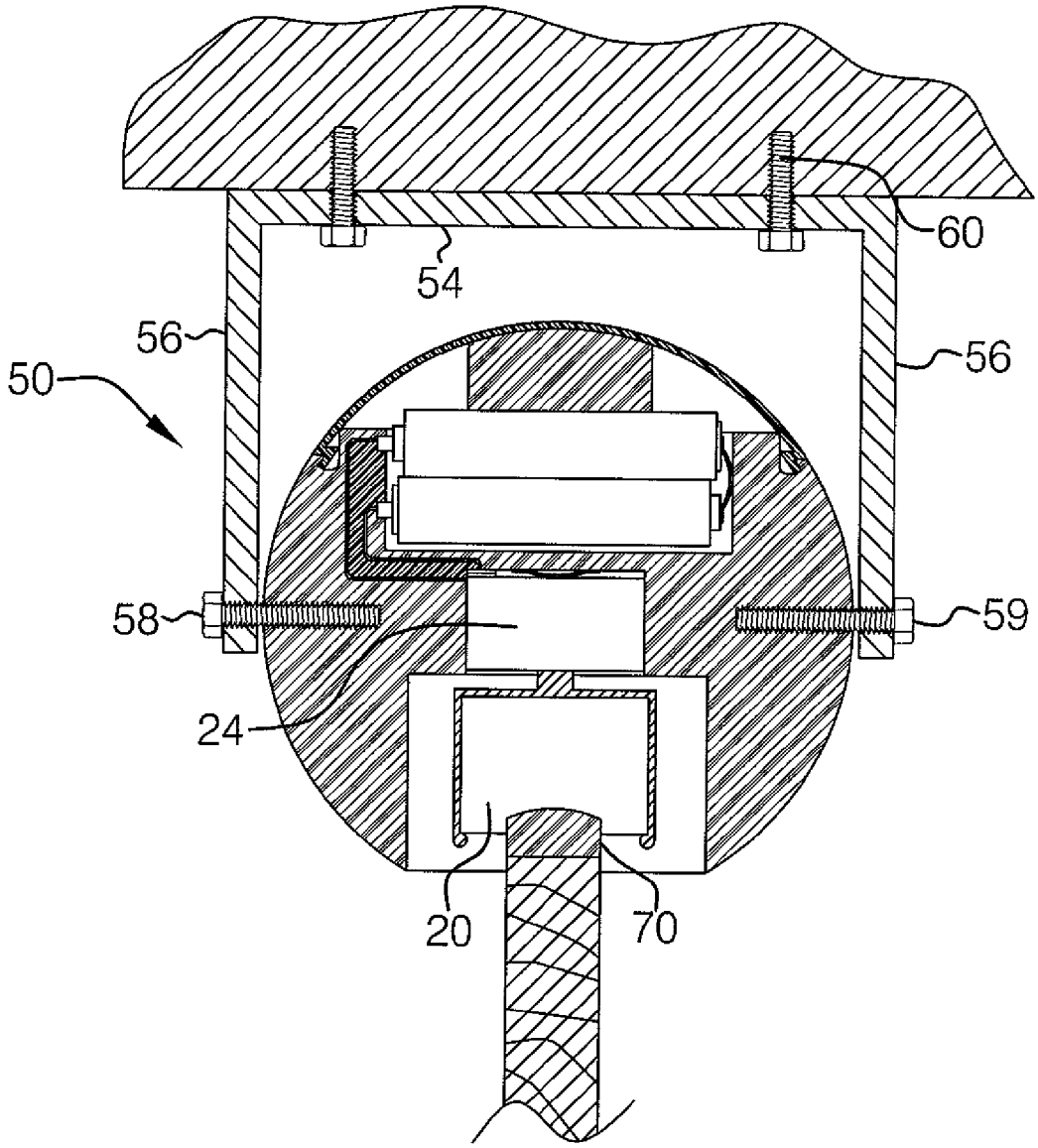
FIG. 4 is a cross-sectional in-use view of the present invention.
Figure 5:
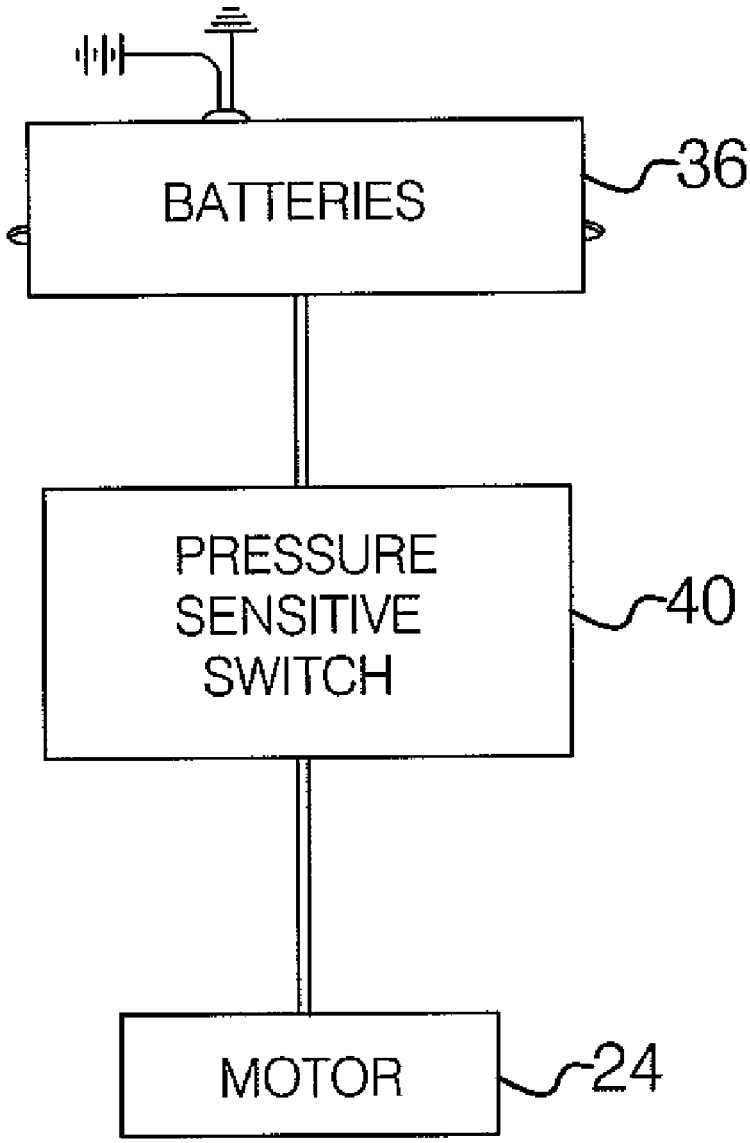
FIG. 5 is a schematic view of the present invention.

With reference now to the drawings, and in particular to FIGS. 1 through 5 thereof, a new cue chalking device embodying the principles and concepts of the present invention and generally designated by the reference numeral 10 will be described.

As best illustrated in FIGS. 1 through 5, the cue tip chalking apparatus 10 generally comprises a housing 12 that has an outer peripheral wall 14. An interior 16 of the housing 12 is defined as being bounded by the peripheral wall 14. The housing 12 has a generally spherical shape. The peripheral wall 14 has a well 18 extending therein that has a size greater than a conventional cue chalk 20. The well 18 has an outer peripheral edge defining an orifice 22 of the well 18.

A motor 24 is mounted within the interior 16 of the housing 12. A drive shaft 26 is attached to the motor 24 and is configured to rotate the drive shaft 26 when the motor 24 is turned on. The drive shaft 26 extends into the well 18 and toward the orifice 22. A saddle 28 is attached to the drive shaft 26 and is positioned in the well 18. The saddle 28 releasably holds a cue chalk 20. The saddle 28 includes a base 30 and a pair of legs 32 that are attached to and extends away from the base 30 in generally same direction as each other. The drive shaft 26 is attached to the base 30. The legs 32 extend toward the orifice 22 and each of the legs 32 has a terminal end 34 comprising a catch. The terminal ends 34 are biased toward each other by the material of the legs, which may be a metal or a plastic. The cue chalk 20 is positioned between the legs 32 and the terminal ends 34 that retain the cue chalk 20 against the base 30.

A power source 36 is electrically coupled to the motor 24. The power source 36 comprises at least one battery mounted in the interior 16 of the housing 12. A door 38 is positioned in the peripheral wall 14 to allow selective access to the at least one battery. An actuator 40 is electrically coupled to the motor 24 and to the power source 36. The actuator 40 is positioned in an on position to turn the motor 24 on or in an off position to turn the motor 24 off. The motor 24 rotates the drive shaft 26 when the actuator 40 is placed in the on position. The actuator 40 is mechanically coupled to the saddle 28. The actuator 40 is moved to the on position when the saddle 28 is urged away from the orifice 22. The actuator 40 is biased toward the off position by a biasing spring 42. The biasing spring 42 may be positioned between the motor 24 and an interior wall 44 of the housing 12. The actuator 40 includes a first contact 46 mounted on the interior wall 44 and a second contact 48 mounted on the motor 24. When the saddle 28 is moved toward the motor 24 by a cue tip 70, the second contact 48 moves toward and abuts the first contact 46 to close a circuit and turn the motor 24 on.

A wall mounting 50 is attached to the housing 12 and mounts the housing 12 to a wall surface 51. The wall mounting 50 includes a bracket 52 that is attached to the housing 12. The bracket 52 is U-shaped and includes a central member 54 and pair of arms 56 that are attached to the central member 54.

A plurality of fasteners 58, 59, 60 is provided. A first fastener 58 of the fasteners extends through one of the arms 56 and into the peripheral wall 14. A second fastener 59 of the fasteners extends through the other one of the arms 56 and into the peripheral wall 14. At least one of the fasteners 60 extends through the central member 54 and into the wall surface 51.

When the wall mounting 50 is not used, the shape of the housing 12 allows the orifice 22 to be used to stabilize the housing 12 when it is placed on a flat surface, such as the edge of a pool table. This is done by simply abutting the orifice 22 on the flat surface, and using it as the base of the housing, which prevents the housing 12 from rolling on the flat surface.

In use, wherein the cue tip 70 is abutted against the cue chalk 20 and the cue 71 is used to urge the actuator 40 into the on position. This causes the motor 24 to rotate the saddle 28 along with the cue chalk 20. This action places or deposits chalk on the cue tip 70.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A cue tip chalking apparatus configured to automatically place chalk on the cue tip of a cue, said apparatus comprising:

a housing having an outer peripheral wall, an interior of said housing being defined as being bounded by said peripheral wall, said peripheral wall having a well extending therein, said well having a size greater than a cue chalk, said well having an outer peripheral edge defining an orifice of said well;

a motor being mounted within said interior of said housing, a drive shaft being attached to said motor, said motor being configured to rotate said drive shaft when said motor is turned on, said drive shaft extending into said well and toward said orifice;

a saddle being attached to said drive shaft and being positioned in said well, said saddle releasably holding a cue chalk, said saddle including a base and a pair of legs being attached to and extending away from said base in generally same direction as each other, said drive shaft being attached to said base, said legs extending toward said orifice, each of said legs having a terminal end comprising a catch, said terminal ends being biased toward each other, the cue chalk being positioned between said legs and said terminal ends, said terminal ends retaining the cue chalk against the base said terminal ends being positioned within said housing;

a power source being electrically coupled to said motor;

an actuator being electrically coupled to said motor and to said power source, said actuator including a first contact mounted on said interior wall and a second contact mounted on said motor;

wherein when said saddle is moved toward said motor by the cue tip of said cue, said second contact moves toward and abuts said first contact to close a circuit and to turn said motor on, said motor rotating said drive shaft when said actuator is placed in said on position; and wherein the cue tip is abutted against the cue chalk and the cue shaft rotated by the motor to place chalk on the cue tip.

2. The apparatus according to claim 1, wherein said power source comprises at least one battery mounted in said interior of said housing, a door being positioned in said peripheral wall to allow selective access to said at least one battery.

3. The apparatus according to claim 1, wherein said actuator is mechanically coupled to said saddle, said actuator being moved to said on position when said saddle is urged away from said orifice, said actuator being biased toward said off position.

4. The apparatus according to claim 1, further including a wall mounting being attached to said housing and mounting said housing to a wall surface.

5. The apparatus according to claim 4, wherein said wall mounting includes:

a bracket being attached to said housing, said bracket being U-shaped and including a central member and pair of arms being attached to said central member; and a plurality of fasteners, a first fastener of said fasteners extending through one of said arms and into said peripheral wall, a second fastener of said fasteners extending through the other one of said arms and into said peripheral wall, at least one of said fasteners extending through said central member and into said wall surface.

6. The apparatus according to claim 5, wherein said actuator is mechanically coupled to said saddle, said actuator being moved to said on position when said saddle is urged away from said orifice, said actuator being biased toward said off position.

7. A cue tip chalking apparatus configured to automatically place chalk on the cue tip of a cue, said apparatus comprising:

a housing having an outer peripheral wall, an interior of said housing being defined as being bounded by said peripheral wall, said housing having a generally spherical shape, said peripheral wall having a well extending therein, said well having a size greater than a cue chalk, said well having an outer peripheral edge defining an orifice of said well;

a motor being mounted within said interior of said housing, a drive shaft being attached to said motor, said motor being configured to rotate said drive shaft when said motor is turned on, said drive shaft extending into said well and toward said orifice;

a saddle being attached to said drive shaft and being positioned in said well, said saddle releasably holding a cue chalk, said saddle including a base and a pair of legs being attached to and extending away from said base in generally same direction as each other, said drive shaft being attached to said base, said legs extending toward said orifice, each of said legs having a terminal end comprising a catch, said terminal ends being biased toward each other, the cue chalk being positioned between said legs and said terminal ends, said terminal ends retaining the cue chalk against the base;

a power source being electrically coupled to said motor, said power source comprising at least one battery mounted in said interior of said housing, a door being positioned in said peripheral wall to allow selective access to said at least one battery;

an actuator being electrically coupled to said motor and to said power source, said actuator including a first contact mounted on said interior wall and a second contact mounted on said motor;

wherein when said saddle is moved toward said motor by the cue tip of said cue, said second contact moves toward and abuts said first contact to close a circuit and to turn said motor on, said motor rotating said drive shaft when said actuator is placed in said on position, a wall mounting being attached to said housing and mounting said housing to a wall surface, said wall mounting including;

a bracket being attached to said housing, said bracket being U-shaped and including a central member and pair of arms being attached to said central member;

a plurality of fasteners, a first fastener of said fasteners extending through one of said arms and into said peripheral wall, a second fastener of said fasteners extending through the other one of said arms and into said peripheral wall, at least one of said fasteners extending through said central member and into said wall surface; and wherein the cue tip is abutted against the cue chalk and the cue chalk rotated by the motor to place chalk on the cue tip.

* * * * *